US005726698A

United States Patent [19]

Shinozaki et al.

[11] Patent Number: 5,726,698

[45] Date of Patent: Mar. 10, 1998

[54] METHOD FOR THERMAL TRANSFER RECORDING OF MULTICOLOR IMAGE

[75] Inventors: Fumiaki Shinozaki; Hideyuki Nakamura; Yonosuke Takahashi, all of Shizuoka, Japan

[73] Assignee: Fuji Photo Film Co., Ltd., Kanagawa, Japan

[21] Appl. No.: 327,409

[22] Filed: Oct. 21, 1994

[30] Foreign Application Priority Data

Oct. 21, 1993 [JP] Japan ..... 5-263695

[51] Int. Cl.[6] ..... B41J 2/525; B41J 2/325

[52] U.S. Cl. ..... 347/172; 347/217

[58] Field of Search ..... 347/213, 217, 347/171, 172, 221; 156/234, 235, 237, 240; 428/913; 928/914

[56] References Cited

U.S. PATENT DOCUMENTS

| | | | |
|---|---|---|---|
| 5,071,502 | 12/1991 | Hashimoto et al. | 156/234 |
| 5,332,459 | 7/1994 | Imai et al. | 347/213 |
| 5,448,282 | 9/1995 | Imai et al. | 347/213 |

*Primary Examiner*—Huan H. Tran

*Attorney, Agent, or Firm*—Birch, Stewart, Kolasch & Birch, LLP

[57] ABSTRACT

A method for thermal transfer recording of a multicolor image which utilizes a heat sensitive ink sheet having a support sheet and a transparent heat sensitive ink layer having a thickness of 0.2 to 1.0 μm which is formed of a heat sensitive ink material comprising 30 to 70 weight parts of a colored pigment at least 70 weight % of which has a particle size of not more than 1.0 μm and 25 to 60 weight parts of amorphous organic polymer having a softening point of 40° to 150° C.

11 Claims, 3 Drawing Sheets

MEDIAN SIZE = 0.154μm

SPECIFIC SURFACE AREA = 422354cm²/cm³

PARTICLE SIZE % : 10.00μm = 100.0%

% PARTICLE SIZE : 90.0% = 0.252μm

MEDIAN SIZE = 0.154μm
SPECIFIC SURFACE AREA = 422354cm²/cm³

PARTICLE SIZE % : 10.00μm = 100.0%
% PARTICLE SIZE : 90.0% = 0.252μm

MEDIAN SIZE = 0.365μm
SPECIFIC SURFACE AREA = 189370cm²/cm³

PARTICLE SIZE % : 10.00μm = 100.0%
% PARTICLE SIZE : 90.0% = 0.599μm

METHOD FOR THERMAL TRANSFER RECORDING OF MULTICOLOR IMAGE

FIELD OF THE INVENTION

This invention relates to a method for thermal transfer recording of a multicolor image and a heat sensitive ink sheet favorably employable for the recording method. In more detail, the invention relates to a thermal transfer recording method for forming a multicolor image on an image receiving sheet by means of a thermal head printer.

BACKGROUND OF THE INVENTION

Heretofore, there have been known two thermal transfer recording methods for the preparation of a multicolor image which utilize a thermal head printer, that is, a sublimation dye transfer recording method and a fused ink transfer recording method.

The sublimation dye transfer method comprises the steps of superposing on an image receiving sheet a transfer sheet which is composed of a support and a transfer layer comprising a sublimation ink and a binder and imagewise heating the support of the transfer sheet to sublimate the sublimation ink to form an image on the image receiving sheet. A multicolor image can be prepared using a number of color transfer sheets such as a yellow transfer sheet, a magenta transfer sheet, and a cyan transfer sheet.

The sublimation dye transfer recording method, however, has the following drawbacks:

1) The graduation of image is mainly formed by variations of the sublimated dye concentration, which is varied by controlling the amount of sublimation of the dye. Such gradation is appropriate for the preparation of a photographic image, but is inappropriate for the preparation of a color proof which is utilized in the field of printing and whose gradation is formed of dots, lines, or the like, that is, area gradation.

2) The image formed of sublimated dye has poor edge sharpness, and a fine line shows thinner density on its solid portion than a thick line. Such tendency causes serious problem in the quality of character image.

3) The image of sublimated dye is poor in endurance. Such image cannot be used in the fields which require multicolor images resistant to heat and light.

4) The sublimation dye transfer recording method shows sensitivity lower than the fused ink transfer recording method. Such low sensitive recording method is not preferably employable in a high speed recording method utilizing a high resolution thermal head, of which development is expected in the future.

5) The recording material for the sublimation dye transfer recording method is expensive, as compared with the recording material for the fused ink transfer recording method.

The fused ink transfer recording method comprises the steps of superposing on an image receiving sheet a transfer sheet having a support and a thermal fusible transfer layer which comprises a coloring matter (e.g., pigment or dye) and a binder (e.g., wax) and imagewise heating the support of the transfer sheet to portionwise fuse the transfer layer to form and transfer an image onto the image receiving sheet. A multicolor image also can be prepared using a number of color transfer sheets.

The fused ink transfer recording method is advantageous in terms of sensitivity, cost, and endurance of the formed image, as compared with the sublimation dye transfer recording method. It, however, has the following drawbacks:

1) The color image prepared by the fused ink transfer recording method is poor in its quality, as compared with the sublimation dye transfer recording method. This is because the fused ink transfer recording method utilizes not gradation recording but binary (i.e., two valued) recording. Therefore, there have been reported a number of improvements on the fusible ink layer of the fused ink transfer recording method for modifying the binary recording to give a gradation recording so that a color image having multi-gradation is prepared by the fused ink transfer recording method. The basic concept of the heretofore reported improvement resides in portionwise (or locally) controlling the amount of the ink to be transferred onto the image receiving sheet. In more detail, the mechanism of transfer of the ink in the fused ink transfer recording method is as follows; under heating by the thermal head, the viscosity of the ink layer at the site in contact with the thermal head lowers and tends to adhere to the image receiving sheet, whereby the transfer of the ink takes place. Therefore, the amount of the transferred ink can be controlled by varying the elevation of the temperature on the thermal head so that the cohesive failure in the ink layer is controlled and the gamma characteristic of the transferred image is varied. Thus, the optical density of the transferred ink image is portionwise varied, and accordingly, an ink image having gradation is formed. However, the gradation produced by such a modified fused ink transfer recording method is inferior to that produced by the sublimation dye transfer recording method. Moreover, the optical density of a fine line produced by the modified fused ink transfer recording method is not satisfactory.

Further, the fused ink transfer recording method has other disadvantageous features such as low resolution and poor fixation of the transferred ink image. This is because the ink layer generally uses crystalline wax having a low melting point as the binder, and the wax tends to spread on the receiving sheet in the course of transferring under heating. Furthermore, the crystalline wax scarcely gives a transparent image due to light scattering on the crystalline phase. The difficulty in giving a transparent image causes serious problems in the preparation of a multicolor image which is formed by superposing a yellow image, a magenta image, and a cyan image. The requirement of transparency in the formed image restricts the amount of pigment to be incorporated into the ink layer. For instance, Japanese Patent Publication No. 63(1988)-65029 describes that the pigment (i.e., coloring matter) should be incorporated in the ink layer in an amount of not more than 20 weight % based on the total amount of the ink layer. If an excessive amount of the pigment is employed, the transparency of the transferred ink image is made dissatisfactory.

Until now, improvements in reproduction of a multicolor image in the fused ink transfer recording method have been studied and proposed. For instance, Japanese Patent Provisional Publication No. 61(1986)-244592 (=Japanese Patent Publication No. 5(1993)-13072) describes a heat sensitive recording material which has a heat sensitive layer comprising at least 50 weight % of an amorphous polymer, a releasing agent, and a coloring matter (dye or pigment) which can reproduce a color image having continuous gradation with improved transparency and fixation strength. The publication indicates that the amorphous polymer in an amount of less than 50 weight % gives a heat sensitive ink layer of extremely poor transparency and therefore cannot reproduce a satisfactory color image, and at least 70 weight % of the amorphous polymer is required to give a sufficiently transparent ink layer. As for the thickness of the heat-sensitive ink layer, it is described that 0.5 μm to 50 μm, specifically 1 μm to 20 μm, is preferred. The publication indicates the use of the described heat-sensitive recording material for printer, facsimile and duplicating machine, but is silent with respect to the use thereof for the preparation of a color proof. It is known to those skilled in the art that the multicolor image for color proofing should have a reflection density of at least 1.0, preferably approximately 1.4 for each of a cyan image, a magenta image and a yellow image, and approximately 1.7 for a black image. In the publication, there is no teaching on the optical density of the image produced by the use of a transparent pigment ink layer of not thicker than 1 μm. In the working examples, the thickness of the ink layer is approximately 3 μm which is similar to that of the conventional ink layer using wax binder. Thus, the publication does not teach any measure for giving a color image of a reflection density of not less than 1.0 using a recording material with a heat-sensitive ink layer of less than 1.0 μm thick.

As for the thermal head printer, the technology has been very rapidly developed. Recently, the thermal head is improved to give a color image with an increased resolution and multi-gradation which is produced by area gradation. The area gradation means gradation produced not by variation of optical density in the ink area but by size or density of ink spots or lines per unit area. The area gradation is formed by binary recording. Such technology is described in Japanese Patent Provisional Publications No. 4(1992)-19163 and No. 5(1993)-155057 (for divided sub-scanning system) and in the preprint of Annual Meeting of Society of Electrophotography (1992/7/6) (for heat-concentrated system).

SUMMARY OF THE INVENTION

The present invention has an object to provide a new method for thermal transfer recording of a multicolor image having high quality and sufficient resistance to discoloration, utilizing a pigment and area gradation. Such method is expected to be favorably employable, particularly, for the preparation of various multicolor images, such as color proof, block copy, card, outdoor display, meter display, and the like.

According to the study by the present inventors, the following factors are specifically important for forming a multi-gradation multicolor image by area gradation (i.e., binary gradation or binary recording):

1) each color image should have certain reflection density;

2) material of the ink layer is appropriate for giving high resolution;

3) image in the form of partitioned area (e.g., line or dot) should have high edge sharpness;

4) optical density of the partitioned area should be uniform regardless of size of the partitioned area (such as dots or lines);

5) transferred ink layer should have high transparency;

6) recording material should have high sensitivity;

7) formed image should have high fixation strength; and 8) formed color image should show good color reproduction of the original color image.

The conventional image transfer recording method based on the transfer of fused ink, however, is not satisfactory in view of the above requirements.

The present invention provides an improved method for satisfying the above requirements, which is formulated on the concept of area gradation utilizing thin ink film transfer.

The invention resides in a method for thermal transfer recording of a multicolor image by area gradation which comprises the steps of:

superposing a first heat sensitive ink sheet on an image receiving sheet, said first heat sensitive ink sheet having a support sheet and an essentially transparent heat sensitive ink layer having a thickness of 0.2 to 1.0 μm which is formed of a heat sensitive ink material comprising 30 to 70 weight parts of a colored pigment at least 70 weight % of which has a particle size of not more than 1.0 μm and 25 to 60 weight parts of amorphous organic polymer having a softening point of 40° to 150° C.;

placing imagewise a thermal head on the support of the first heat sensitive ink sheet to form and transfer a color image of the heat sensitive ink material onto the image receiving sheet;

separating the support of the ink sheet from the image receiving sheet so that the color image of the heat sensitive ink material is retained on the image receiving sheet;

superposing a second heat sensitive ink sheet on the image receiving sheet having the image thereon, said heat sensitive ink sheet having a support sheet and an essentially transparent heat sensitive ink layer having a thickness of 0.2 to 1.0 μm which is formed of a heat sensitive ink material comprising 30 to 70 weight parts of a pigment of a different color at least 70 weight % of which has a particle size of not more than 1.0 μm and 25 to 60 weight parts of amorphous organic polymer having a softening point of 40° to 150° C.;

placing imagewise a thermal head on the support of the second heat sensitive ink sheet to form and transfer a color image of the heat sensitive ink material onto the image receiving sheet; and separating the support of the ink sheet from the image receiving sheet so that a color image of the heat sensitive ink material is retained on the image receiving sheet.

Figure 1:
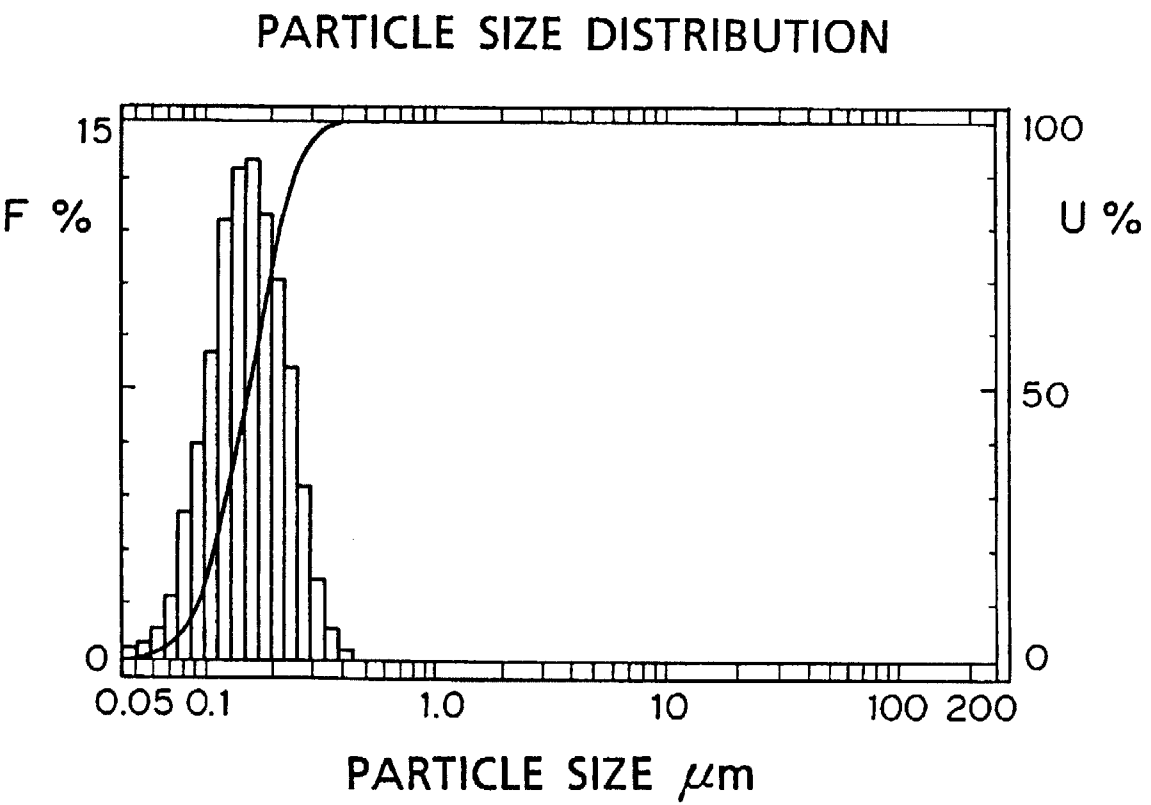
FIG. 1 shows a particle size distribution of cyan pigment employed in Example 1.

In each figure, the axis of abscissas indicates particle size (μm), the left axis of ordinates indicates percentage (%) of particles of the indicated particle sizes, and the right axis of ordinates indicates accumulated percentage (%).

DETAILED DESCRIPTION OF THE INVENTION

The heat-sensitive ink sheet employed in the method of the invention for thermal transfer recording of a multicolor image by area gradation is described below.

The heat-sensitive ink sheet has a support sheet and an essentially transparent heat sensitive ink layer having a thickness of 0.2 to 1.0 μm which is formed of a heat sensitive ink material comprising 30 to 70 weight parts of a colored pigment at least 70 weight % of which has a particle size of not more than 1.0 μm and 25 to 60 weight parts of amorphous organic polymer having a softening point of 40° to 150° C. (preferably 65° to 130° C.).

As the support sheet, any of the materials of the support sheets employed in the conventional fused ink transfer system and sublimation ink transfer system can be employed. Preferably employed is a polyester film of approx. 5 μm thick which has been subjected to release treatment. Such film is used for the conventional transfer recording material in the thermal head printing.

The pigment to be incorporated into the heat sensitive ink layer of the invention can be optionally selected from known pigments. Examples of the known pigments include carbon black, azo-type pigment, phthalocyanine-type pigment, qunacridone-type pigment, thioindigo-type pigment, anthraquinone-type pigment, and isoindolin-type pigment. These pigments can be employed in combination with each other. A known dye can be employed in combination with the pigment for controlling hue of the color image.

Any of amorphous organic polymers having a softening point of 40° to 150° C. can be employed for the preparation of the ink layer of the heat-sensitive ink sheet of the invention. A heat-sensitive ink layer using an amorphous organic polymer having a softening point of lower than 40° C. shows poor sensitivity, and a heat-sensitive ink layer using an amorphous organic polymer having a softening point of higher than 150° C. shows unfavorable adhesion. Example of the amorphous organic polymers include butyral resin, polyamide resin, polyethyleneimine resin, sulfonamide resin, polyester-polyol resin, petroleum resin, homopolymers and copolymers of styrene or its derivatives (e.g., styrene, vinyltoluene, α-methylstyrene, 2-methylstyrene, chlorostyrene, vinylbenzoic acid, sodium vinylbenzenesulfonate and aminostyrene), and homopolymers and copolymers of methacrylic acid or its ester (e.g., methacrylic acid, methyl methacrylate, ethyl methacrylate, butyl methacrylate, and hydroxyethyl methacrylate), homopolymers and copolymers of acrylic acid or its ester (e.g., acrylic acid, methyl acrylate, ethyl acrylate, butyl acrylate, and α-ethylhexyl acrylate), homopolymers and copolymers of a diene compound (e.g., butadiene and isoprene), and homopolymers and copolymers of other vinyl monomers (e.g., acrylonitrile, vinyl ether, maleic acid, maleic acid ester, maleic anhydride, cinnamic acid, vinyl chloride, and vinyl acetate). These resins and polymers can be employed in combination.

Particularly preferred are butyral resin and styrene-maleic acid half ester resin, from the viewpoint of good dispersability of the pigment.

The ink layer can further contain 1 to 20 weight % of additives such as a releasing agent and/or a softening agent based on the total amount of the ink layer so as to facilitate release of the ink layer from the support when the thermal printing (image forming) takes place and increase heat-sensitivity of the ink layer. Examples of the additives include a fatty acid (e.g., palmitic acid and stearic acid), a metal salt of a fatty acid (e.g., zinc stearate), a fatty acid derivative (e.g., fatty acid ester, its partial saponification product, and fatty acid amid), a higher alcohol, a polyol derivative (e.g., ester of polyol), wax (e.g., paraffin wax, carnauba wax, montan wax, bees wax, Japan wax, and candelilla wax), low molecular weight polyolefin (e.g., polyethylene, polypropylene, and polybutyrene) having a viscosity mean molecular weight of approx. 1,000 to 10,000, low molecular weight copolymer of olefin (specifically α-olefin) with organic acid (e.g., maleic anhydride, acrylic acid, and methacrylic acid) or vinyl acetate, low molecular weight oxidized polyolefin, halogenated polyolefin, homopolymer of acrylate or methacrylate (e.g., methacrylate having a long alkyl chain such as lauryl methacrylate and stearyl methacrylate, and acrylate having a perfluoro group), copolymer of acrylate or methacrylate with vinyl monomer (e.g., styrene), low molecular weight silicone resin and silicone modified organic material (e.g., polydimethylsiloxane and polydiphenylsiloxane), cationic surfactant (e.g., ammonium salt having a long aliphatic chain group, and pyridinium salt), anionic and nonionic surfactants having a long aliphatic chain group, and perfluoro-type surfactant.

The heat-sensitive ink layer should show an optical density (in terms of reflection density) of not less than 1.0 when it is transferred onto a white paper sheet after heating.

The thickness of the ink layer should be in the range of 0.2 to 1.0 μm, and preferably in the range of 0.3 to 0.6 μm (more preferably in the range of 0.3 to 0.5 μm). An excessively thick ink layer having a thickness of more than 1.0 μm gives an image of poor gradation on the shadow portion and highlight portion in the reproduction of image by area gradation. A very thin ink layer having a thickness of less than 0.2 μm cannot form an image of acceptable optical reflection density.

In order to prepare an image of appropriate reflection density using an extremely thin ink layer, the heat sensitive ink material should comprise 30 to 70 weight parts of a colored pigment, 25 to 60 weight parts of the amorphous organic polymer, and optionally 1 to 15 weight parts of an additive such as a releasing agent and/or a film softening agent. The pigment of less amount is inappropriate, in view of the required optical reflection density of the formed image.

Moreover, the pigment should have such particle distribution that at least 70 weight % of the pigment particle has a particle size of not more than 1.0 μm. A pigment particle of a large particle size reduces transparency of the formed image, particularly in the area in which a number of color images are overlapped. Further, large particles bring about difficulty to prepare the desired ink layer satisfying the relationship between the preferred thickness and concentration.

The pigment can be appropriately dispersed in the amorphous organic polymer by conventional methods in the art of paint material such as that using a suitable solvent and a ball mill.

The heat-sensitive ink layer of the invention mainly comprises a pigment and an amorphous organic polymer, and the amount of the pigment in the layer is high, as compared with the amount of the pigment in the conventional ink layer using a wax binder. Therefore, the ink layer of the invention shows a viscosity of higher than $10^4$ cps at 150° C. (the highest thermal transfer temperature), while the conventional ink layer shows a viscosity of $10^2$ to $10^3$ cps at the same temperature. Accordingly, when the ink layer of the invention is heated, the ink layer per se is easily peeled from the support and transferred onto an image receiving layer keeping the predetermined reflection density. Such peeling type transfer of the extremely thin ink layer enables to give an image having a high resolution, a wide gradation from a shadow portion to a highlight portion, and satisfactory edge sharpness. Further, the complete transfer (100%) of image onto the image receiving sheet gives desired uniform reflection density even in a small area such as characters of 4 point and a large area such as a solid portion.

As for the image receiving sheet, any of the conventional sheet materials can be employed. For instance, a synthetic paper sheet which becomes soft under heating, and other image receiving sheet materials described in U.S. Pat. No. 4,482,625, No. 4,766,053, and No. 4,933,258 can be employed.

The image receiving sheet preferably has a heat adhesive layer on a support. Such image receiving sheet is known.

The support can be paper sheet or a plastic film such as polyester film, polycarbonate film, polypropylene film or polyvinyl chloride film. If the image transfer recording method of the invention is utilized for the preparation of color proof, the image is once transferred on a plastic film and then again transferred onto a printing paper such as a white paper sheet.

The process of the image transfer recording for preparing a multicolor image per se is known. The image transfer recording method of the invention for the preparation of a color proof of full color type can be performed by the following steps:

superposing a first heat sensitive ink sheet (such as a clan ink sheet) on an image receiving sheet;

placing imagewise a thermal head on the support of the first heat sensitive ink sheet to form and transfer a color image (cyan image) of the heat sensitive ink material onto the image receiving sheet;

separating the support of the ink sheet from the image receiving sheet so that the color image (cyan image) of the heat sensitive ink material is retained on the image receiving sheet;

superposing a second heat sensitive ink sheet (such as magenta ink sheet) on the image receiving sheet having the cyan image thereon;

placing imagewise a thermal head on the support of the second heat sensitive ink sheet to form and transfer a color image (magenta image) of the heat sensitive ink material onto the image receiving sheet;

separating the support of the ink sheet from the image receiving sheet so that an image (magenta image) of the heat sensitive ink material is retained on the image receiving sheet;

superposing a third heat sensitive ink sheets (such as yellow ink sheet) on the image receiving sheet having the cyan image thereon;

placing imagewise a thermal head on the support of the second heat sensitive ink sheet to form and transfer a color image (yellow image) of the heat sensitive ink material onto the image receiving sheet;

separating the support of the ink sheet from the image receiving sheet so that an image (yellow image) of the heat sensitive ink material is retained on the image receiving sheet, whereby a multicolor image is formed on the image receiving sheet; and transferring thus prepared multicolor image onto a white paper sheet.

The present invention is further described in more detail by the following examples.

Example 1

Figure 3:
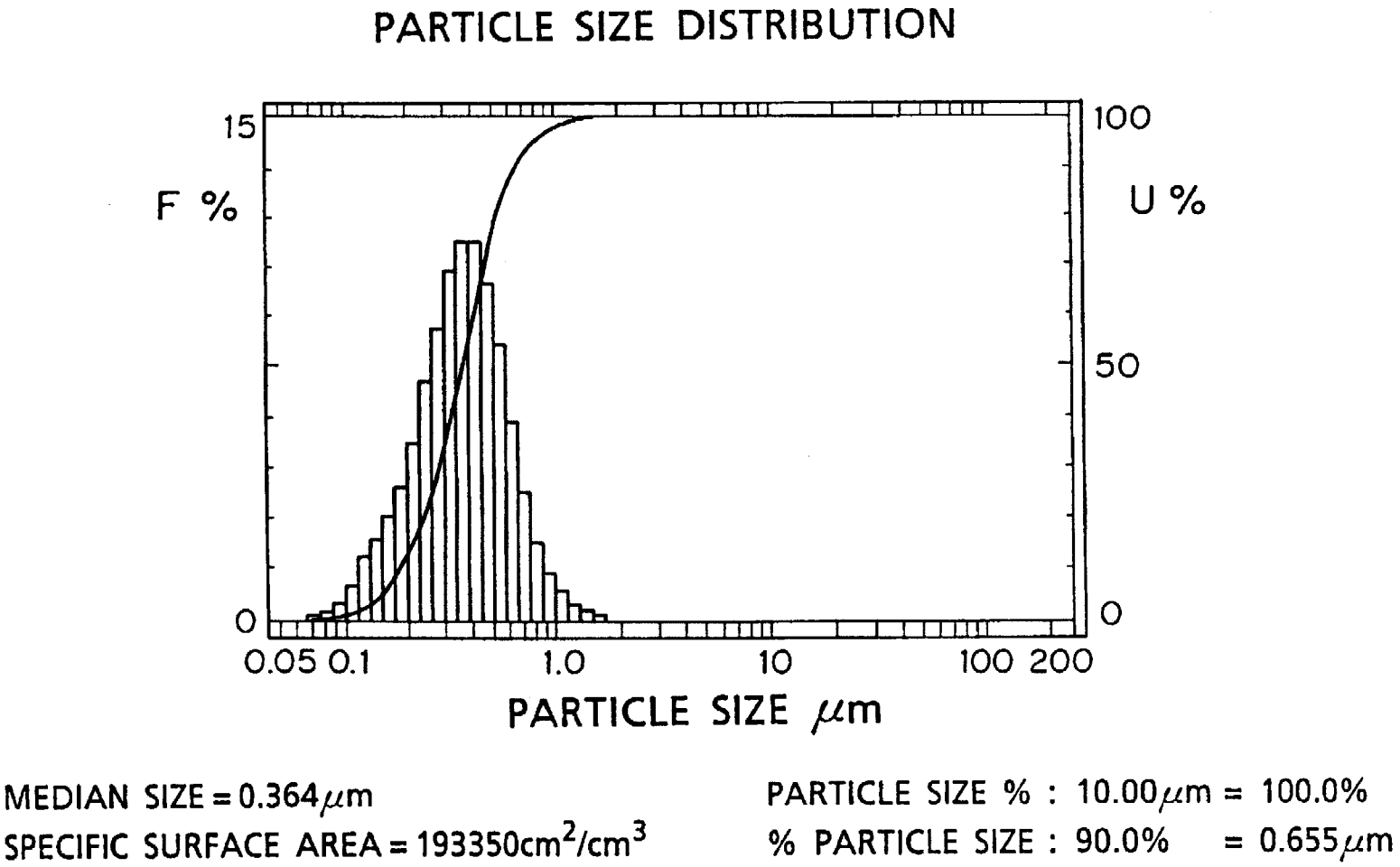
FIG. 3 shows a particle size distribution of yellow pigment employed in Example 1.
Figure 2:
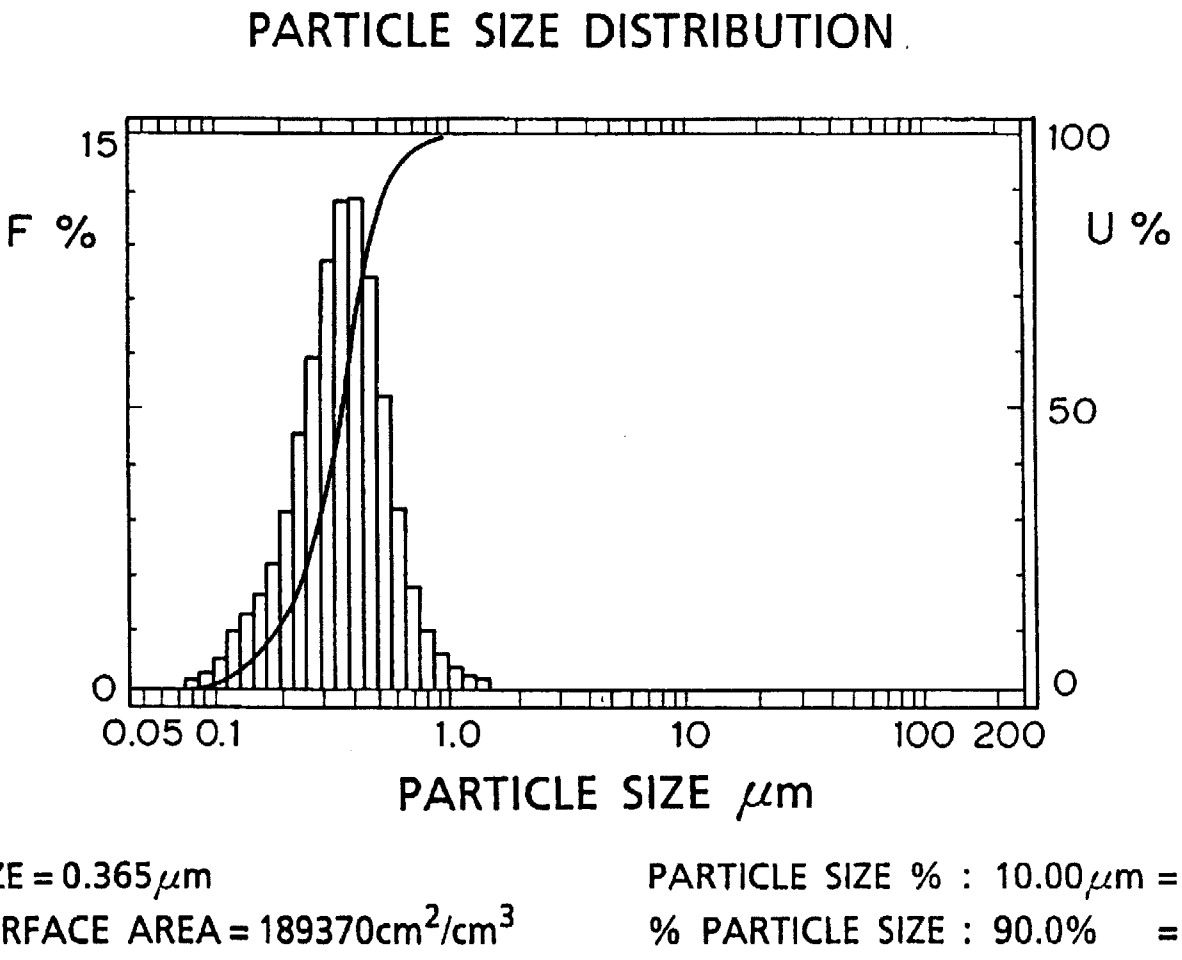
FIG. 2 shows a particle size distribution of magenta pigment employed in Example 1.

The following three pigment dispersions were prepared:

1) Cyan pigment dispersion
   Cyan pigment (CI, P.B. 15:4) 12 g
   Binder solution 123.2 g
2) Magenta pigment dispersion
   Magenta pigment (CI, P.R. 57:1) 12 g
   Binder solution 123.2 g
3) Yellow pigment dispersion
   Yellow pigment (CI, P.Y. 14) 12 g
   Binder solution 123.2 g The binder solution comprised the following components:

Butyral resin (tradename, Eslec FPD-1, available from Sekisui Chemical Industries Co., Ltd., softening point: approx. 70° C., mean polymerization degree: less than 300) 12.0 g Solvent (n-propyl alcohol: n-PrOH) 110.4 g Dispersing agent (tradename, Solsparse S-20000, available from ICI Japan KK) 0.8 g The particle size distributions of the pigments in the dispersions are shown in the attached figures, wherein FIG. 1 indicates the distribution of cyan pigment; FIG. 2 shows the distribution of magenta pigment; and FIG. 3 shows the distribution of yellow pigment. In each figure, the axis of abscissas indicates particle size (μm), the left axis of ordinates indicates percentage (%) of particles of the indicated particle sizes, and the right axis of ordinates indicates accumulated percentage (%).

To 100 g of each pigment dispersion were added 0.24 g of stearylamide and 60 g of n-PrOH to give a coating liquid. Each of thus obtained coating liquids was coated on a polyester film (thickness: 5 μm, available from Teijin K.K.) having been made easily releasable. Thus, a cyan ink sheet having a support and a cyan ink layer of 0.36 μm, a magenta ink sheet having a support and a magenta ink layer of 0.38 μm, and a yellow ink sheet having a support and a yellow ink layer of 0.42 μm were prepared.

Also prepared was an image receiving sheet having an adhesive layer of 5 μm thick (dry thickness), by coating the following coating solution on a polyester film (thickness: 100 μm):

Polyethyleneimine (tradename SP-200, available from Nippon Catalyst Chemical Industries, Co., Ltd.) 36 g Butyral resin (FPD-1) 162 g n-Propyl alcohol 970 g Methylcellosolve 170 g Initially, the cyan ink sheet was superposed on the image receiving sheet, and a thermal head was placed on the cyan ink sheet side for imagewise forming a cyan image by the known divided sub-scanning method. The divided sub-scanning method was performed with multiple modulation for giving area gradation by moving a thermal head of 75 μm×50 μm in one direction at a pitch of 3 μm along 50 μm length. The support of the cyan ink sheet was then peeled off from the image receiving sheet on which a cyan image with area gradation was maintained. On the image receiving sheet having the cyan image was superposed the magenta ink sheet, and the same procedure was repeated for placing a magenta image with area gradation on the image receiving sheet having the yellow image. The yellow ink sheet was then superposed on the image receiving sheet having the cyan and magenta images thereon in the same manner, and the same procedure was repeated for placing a yellow image with area gradation on the image receiving sheet. Thus, a multicolor image was formed on the image receiving sheet.

Subsequently, an art paper sheet is placed on the image receiving sheet having the multicolor image, and they were passed through a couple of heat rollers under the conditions of 130° C., 4 Kg/cm and 4 m/sec. Then, the polyester film of the image receiving sheet was peeled off for maintaining a multicolor image on the art paper sheet. Quality of thus obtained multicolor image was high, and was on the same level as a chemical proof prepared from a lith-type film (Color Art, available from Fuji Photo Film Co., Ltd.).

The following is optical reflection density of a solid portion of each color image:

Cyan image: 1.54

Magenta image: 1.42

Yellow image: 1.57

The optical reflection density on characters of 4 point which was measured by means of a microdensitometer was almost the same as above.

The gradation reproduction was observed in the range of 5% to 95%.

For comparison, a commercially available fused ink transfer recording sheet using a wax binder was tested by performing the same image forming procedures. It was found that the obtained multicolor image had poor gradation, and the gradation reproduction was in the range of 20% to 70%.

Example 2

The image receiving sheet of Example 1 was replaced with a commercially available synthetic paper sheet (EPSON PAPER B100 4780, cut paper, B100-CVPB100) and the same multicolor image forming procedures were performed. Satisfactory results which were observed in Example 1 were also seen in the obtained multicolor image.

We claim:

1. A method for thermal transfer recording of a multicolor image by area gradation which comprises the steps of:

superposing a first heat sensitive ink sheet on an image receiving sheet, said first heat sensitive ink sheet having a support sheet and an essentially transparent heat sensitive ink layer having a viscosity of higher than $10^4$ cps at 150° C. and a thickness of 0.2 to 1.0 μm which is formed of a heat sensitive ink material comprising 30 to 70 weight parts of a colored particulate pigment at least 70 weight % of which has a particle size of not more than 1.0 μm and 25 to 60 weight parts of amorphous organic polymer having a softening point of 40° to 150° C.;

placing imagewise a thermal head on the support of the first heat sensitive ink sheet to imagewise peel the ink layer off and transfer the peeled ink layer onto the image receiving sheet;

separating the support of the ink sheet from the image receiving sheet so that the transferred ink layer is retained on the image receiving sheet;

superposing a second heat sensitive ink sheet on the image receiving sheet having the image thereon, said heat sensitive ink sheet having a support sheet and an essentially transparent heat sensitive ink layer having a viscosity of higher than $10^4$ cps at 150° C. and a thickness of 0.2 to 1.0 μm which is formed of a heat sensitive ink material comprising 30 to 70 weight parts of a particulate pigment of a different color than said pigment in said first heat sensitive ink sheet, at least 70 weight % of which has a particle size of not more than 1.0 μm and 25 to 60 weight parts of amorphous organic polymer having a softening point of 40° to 150° C.;

placing imagewise a thermal head on the support of the second heat sensitive ink sheet to imagewise peel the ink layer off and transfer the peeled ink layer onto the image receiving sheet; and separating the support of the ink sheet from the image receiving sheet so that the transferred ink layer is retained on the image receiving sheet.

2. The method for thermal transfer recording of a multicolor image as defined in claim 1, wherein each of the color images transferred onto the image receiving layer gives an optical reflection density of at least 1.0 on a white paper sheet.

3. The method for thermal transfer recording of a multicolor image as defined in claim 1, wherein each of the amorphous organic polymers of the first and second heat sensitive ink sheets is butyral resin or styrene-maleic acid half-ester resin.

4. The method for thermal transfer recording of a multicolor image as defined in claim 1, wherein each of the heat sensitive ink layers of the first and second heat sensitive ink sheets further contains 1 to 15 weight parts of an additive selected from the group consisting of a releasing agent and a softening agent.

5. The method for thermal transfer recording of a multicolor image as defined in claim 1, wherein the image receiving sheet comprises a transparent support and an image receiving layer comprising an amorphous organic polymer having a softening point of 40° to 150° C.

6. A heat sensitive ink sheet having a support sheet and an essentially transparent heat sensitive ink layer having a viscosity of higher than $10^4$ cps at 150° C. and a thickness of 0.2 to 1.0 μm which is formed of a heat sensitive ink material comprising 30 to 70 weight parts of a colored particulate pigment at least 70 weight % of which has a particle size of not more than 1.0 μm and 25 to 60 weight parts of amorphous organic polymer having a softening point of 40° to 150° C.

7. The heat sensitive ink sheet as defined in claim 6, wherein the amorphous organic polymer is butyral resin or styrene-maleic acid half-ester resin.

8. The heat sensitive ink sheet as defined in claim 6, wherein the amorphous organic polymer has a softening point of 65° to 130° C.

9. The heat sensitive ink sheet as defined in claim 6, wherein the essentially transparent heat sensitive ink layer further contains 1 to 15 weight parts of an additive selected from the group consisting of a releasing agent and a softening agent.

10. The method for thermal transfer recording of a multicolor image as defined in claim 1, wherein the thickness of each ink layer is in the range of 0.3 to 0.6 μm.

11. The heat sensitive ink sheet as defined in claim 6, wherein the thickness of the ink layer is in the range of 0.3 to 0.6 μm.

* * * * *